US005810219A

United States Patent [19]

Rosenfield

[11] Patent Number: 5,810,219

[45] **Date of Patent: *Sep. 22, 1998**

[54] GUN SLING

[76] Inventor: Daniel E. Rosenfield, 2101 Crystal Plaza Arcade, #354, Arlington, Va. 22202

[ * ] Notice: This patent issued on a continued prosecution application filed under 37 CFR 1.53(d), and is subject to the twenty year patent term provisions of 35 U.S.C. 154(a)(2).

[21] Appl. No.: 733,985

[22] Filed: Oct. 18, 1996

[51] Int. Cl.[6] ..... F41C 23/02

[52] U.S. Cl. ..... 224/150; 224/149; 224/258; 224/913

[58] Field of Search ..... 224/149, 150, 224/913, 917, 257, 258

[56] References Cited

U.S. PATENT DOCUMENTS

| | | | |
|---|---|---|---|
| 1,183,843 | 5/1916 | Badger . | |
| 1,194,699 | 8/1916 | Badger . | |
| 1,210,475 | 1/1917 | Hooper . | |
| 1,309,605 | 7/1919 | Badger . | |
| 1,323,701 | 12/1919 | Lethern . | |
| 2,296,733 | 9/1942 | Paolino | 42/85 |
| 2,576,559 | 11/1951 | Benner | 224/149 |
| 2,608,733 | 9/1952 | Wilber | 224/913 |
| 2,715,989 | 8/1955 | Sjodin et al. . | |
| 2,884,172 | 4/1959 | Kubo | 224/149 |
| 2,885,812 | 5/1959 | Arpin | 42/85 |
| 2,915,233 | 12/1959 | Moomaw | 224/149 |
| 3,595,451 | 7/1971 | Branby | 224/913 |
| 4,299,343 | 11/1981 | Atchisson | 224/913 |
| 4,562,945 | 1/1986 | Erlandson | 224/150 |
| 4,665,641 | 5/1987 | Llames | 42/85 |
| 4,768,689 | 9/1988 | Davis | 224/257 |
| 4,817,835 | 4/1989 | Tarr, Jr. | 224/150 |
| 4,941,604 | 7/1990 | Nagareda | 224/160 |
| 4,982,883 | 1/1991 | Ullal et al. | 224/917 |
| 5,016,793 | 5/1991 | Derkatz | 224/209 |
| 5,282,558 | 2/1994 | Martinez | 224/913 |
| 5,323,940 | 6/1994 | Hart | 224/150 |
| 5,353,538 | 10/1994 | Hakedal et al. | 42/85 |
| 5,433,360 | 7/1995 | Rock | 224/258 |

FOREIGN PATENT DOCUMENTS

| | | | |
|---|---|---|---|
| 487474 | 7/1918 | France | 224/150 |
| 56495 | 10/1890 | Germany | 224/913 |

*Primary Examiner*—Allan N. Shoap
*Assistant Examiner*—Gregory Vidovich

[57] ABSTRACT

A rifle sling includes a longitudinally-extending strap which is joined together to form a loop. This loop is attached to a rifle at two spaced-apart points which divide the loop into two relatively equal portions. These portions are constructed and arranged for passing over the shoulders of an individual to carry the rifle in a backpack position, with the rifle in a generally vertical position when the individual is upright. A rapid-release buckle is disposed in one portion to facilitate the rapid removal of the rifle from the backpack position to a firing position. The sling is also constructed and arranged to simultaneously shorten the two generally-equal portions, so that the sling may be used as a support during aiming or firing of the rifle. A fastener is also provided for maintaining the sling in its firing position. In addition, a rear strap mount for the sling is also disclosed.

11 Claims, 5 Drawing Sheets

GUN SLING

FIELD OF THE INVENTION

This invention relates to an improved gun sling and, more particularly, to an improved gun sling for a rifle or other long gun.

BACKGROUND FOR THE INVENTION

Slings which are used to carry rifles or other long firearms typically extend between a forward portion of a weapon and a rear portion of the stock. Such slings support the weight of the firearm from a user's shoulder and relieve the user from the burden of carrying the firearm with his or her arm, except during periods in which it is anticipated that the firearm will be brought into a firing position.

A U.S. Pat. No. 4,817,835, of Tarr, Jr., discloses a backpack design, which allows a gun to be carried over a person's shoulders, or across his or her back. Carrying a relatively heavy, long gun in the backpack position distributes the weight of the gun more evenly across the body, reduces fatigue and the likelihood of a life-threatening discharge. At the same time, the backpack design frees, for other tasks, both hands of the person carrying the firearm.

A U.S. Pat. No. 5,323,940, of Hart, discloses a more recent approach to gun slings. The Hart patent discloses a fall-away sling attachment for a butt of a gun which allows a user to carry the firearm in a ready position, in comfort, from his or her shoulder. The sling also permits the user to quickly bring the firearm to a firing position without removing anything and without interference with the movement of the firearm to, and placement at, the firing position.

While the gun slings of the aforementioned type, and others, serve their intended purposes, it is presently believed that there is a commercial market for an improved sling. For example, police officers, particularly members of a SWAT team, military personnel and a number of hunters may favor a backpack design, which frees both hands when in the backpack position and reduces fatigue. However, at times, it is vitally important to quickly bring the firearm to a firing position. Accordingly, an improved gun sling, in accordance with the present invention, incorporates a backpack design and, at the same time, facilitates removing the firearm from the backpack position and bringing it into the firing position.

In addition, the gun sling, in accordance with a preferred embodiment of the present invention, includes a rapid-release mechanism for transferring the gun from the backpack position to a firing position and means for rapidly and accurately converting the sling to a support having a preselected length for use in the firing position.

BRIEF SUMMARY OF THE INVENTION

In essence, a gun sling for a rifle, or the like, includes a longitudinally extending strap having two opposite end regions which are joined together to form a first or overall loop. The sling also includes first and second attaching means for attaching the overall loop to the rifle, or the like, at two longitudinally spaced-apart points on the rifle. Dividing means for dividing the overall loop into two generally-equal portions are also provided. With this arrangement, the two generally-equal portions pass over the shoulders of an individual, procuring the rifle, or the like, on the back of the individual in a backpack position when the two are in a first position with respect to one another. Means are also provided for preventing one end of each of the equal portions from movement with respect to each other, and with respect to the rifle. In addition, the sling includes means for simultaneously shortening the generally-equal portions by folding the portions over upon themselves, and for bringing the sling into a firing position. Means are also provided for maintaining the sling in the firing position.

A preferred embodiment of the invention contemplates a rifle sling having a longitudinally extending strap of nylon or other web-like material. This strap has two opposite end-regions which are joined together to form a first, or overall, loop. The sling also includes first and second attaching means, such as a butt-swivel and stock-swivel for attaching the overall loop to the rifle at two longitudinally spaced-apart points. Dividing means, such as a clip or pin, are provided for dividing the overall loop into two generally-equal portions. In the presently preferred embodiment of the invention, the clip, or pin, also fixes the position of each of the loops with respect to one another, and with respect to the rifle. The two generally-equal portions are constructed and arranged for passing over the shoulders of an individual, procuring the rifle in a backpack position, with the rifle in a generally vertical position when the individual is upright. In other words, the rifle is carried on the back of the individual, approximately midway between the shoulder blades, and generally parallel to the longitudinal axis of the individual when the portions are in a first position with respect to one another. An important, if not key, element in the preferred embodiment of the invention is a rapidly releasable means, which is disposed in one of the portions. This rapidly releasable means, such as a side-release buckle, separates one of the portions, i.e., the one which passes over a shoulder of an individual, to facilitate the rapid removal of the rifle from the backpack position for rapid movement to a firing position. A sling, in accordance with this embodiment, also includes means for simultaneously shortening the generally-equal portions by folding a forward portion of each of the portions over upon themselves for bringing the sling into a firing position, and means for maintaining the sling in the firing position.

The invention will now be described in connection with the accompanying drawings, wherein like reference numerals have been used to designate like parts.

DETAILED DESCRIPTION OF THE PREFERRED EMBODIMENTS OF THE INVENTION

Figure 1:
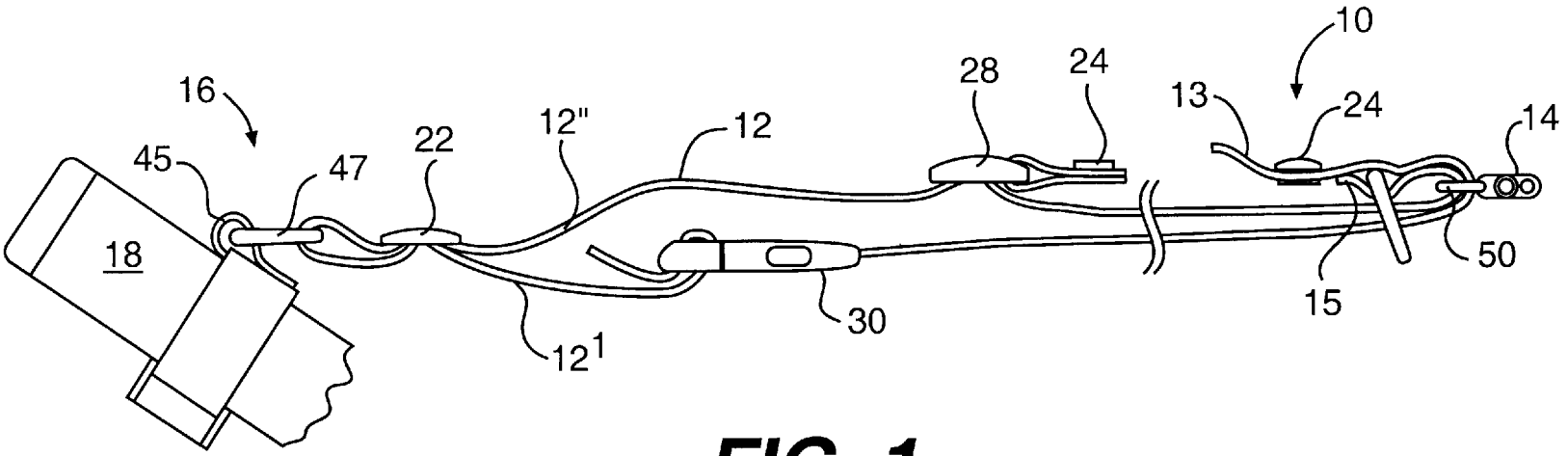
FIG. 1 is a side elevational view of a rifle sling, in accordance with one embodiment of the invention, wherein the sling is illustrated in a substantially fully-extended position.
Figure 2:
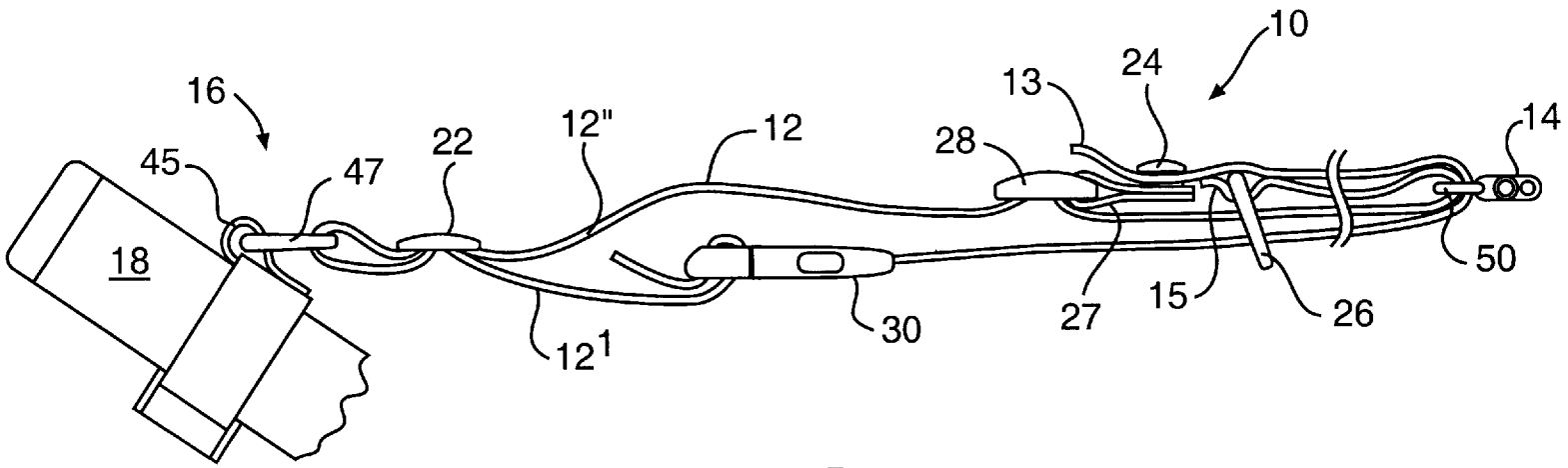
FIG. 2 is a side elevational view of the rifle sling shown in FIG. 1, but with the sling in a second, or firing, position.

As illustrated in FIGS. 1 and 2, a rifle sling 10 includes a strap 12 which is formed of a suitable flexible material, such as a nylon web of the type which is typically used for rifle slings. The strap 12 has two opposite end-portions 13 and 15, which are joined together to form a first overall loop.

Figure 3:
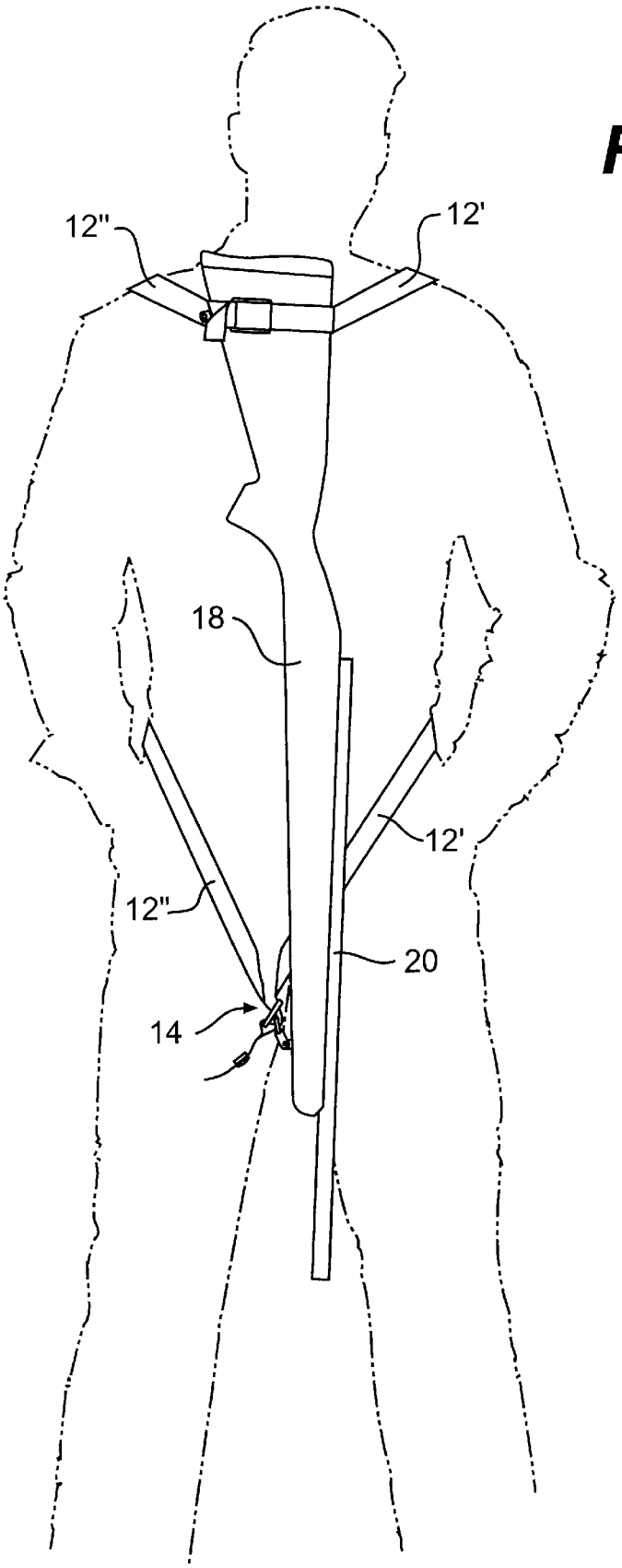
FIG. 3 is a fragmentary, and somewhat diagrammatical, view of an upright human figure, showing a rifle sling, in accordance with a preferred embodiment of the invention, with a rifle (shown schematically) carried in a backpack position.
Figure 7A:
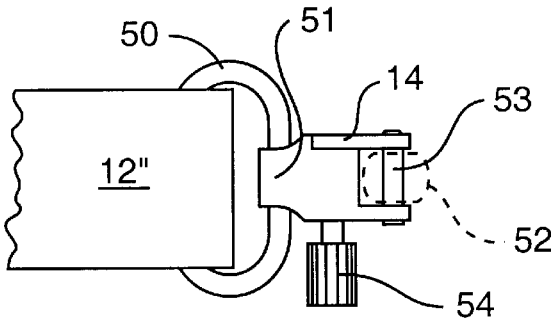
FIG. 7A is a top or plan view which illustrates the attachment mechanism for attaching a sling to a forward portion of a rifle stock.
Figure 7B:
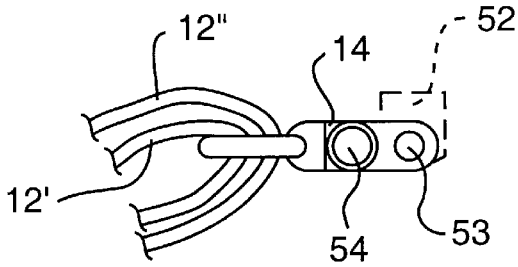
FIG. 7B is a side elevational view illustrating the attachment mechanism shown in FIG. 7A.

The strap 12 includes first attaching means, such as a sling swivel 14, at a first or forward portion of a rifle stock 18 (see FIGS. 3, 7A and 7B). The sling swivel 14 is of a conventional design, as, for example, the swivel-band mount attachment which is disclosed in the U.S. Pat. Nos. 5,323,940 of Hart and 5,433,360 of Rock, both of which are included herein in their entirety by reference. The strap 12 also includes second attachment means 16, which attaches the strap 12 to a rear or butt portion of the rifle stock 18. The two mounts (swivel 14 and means 16) divide the overall loop into two generally-equal portions 12', 12", i.e., an upper and lower portion, as illustrated in FIGS. 1 and 2.

These two equal portions 12', 12" (as shown in FIG. 3) pass over the shoulders of an individual for carrying a rifle 20 on the back of the individual in a backpack position. As illustrated, the barrel of the rifle 20 is pointed toward the ground. As shown in FIGS. 1 and 2, a sliding clip or clamp 22 is positioned close to the attachment means 16 for maintaining the length of portion 12', 12" in a condition wherein the portions are of substantially equal length. When the sling 10 is disposed in a backpack position, the portions 12', 12" each has a relatively long length.

As shown in FIG. 1, the portions 12', 12" are extended to the backpack position by releasing a fastening means, such as a snap fastener 24. Releasing the snap fastener 24 allows the ends 13 and 15 (see FIG. 1) to move to the right. This movement allows the portions 12' and 12", which have been folded over upon themselves, to reach a fully extended, or backpack, position. For example, an upper run of the two portions 12' and 12" pass through the sling swivel 14 and are folded over upon themselves, i.e., with respect to a lower run, and guided by a D-shaped ring or guide member 26. The sling 10 is then converted from a shortened, or firing position, to the fully extended, or backpack position, as shown in FIG. 3. For comparison, FIG. 2 shows the portions 12', 12" passing through the sling swivel 14 and drawn back or moved to the left to a shortened, or firing, position and held in place by the snap fastener 24.

Figure 5:
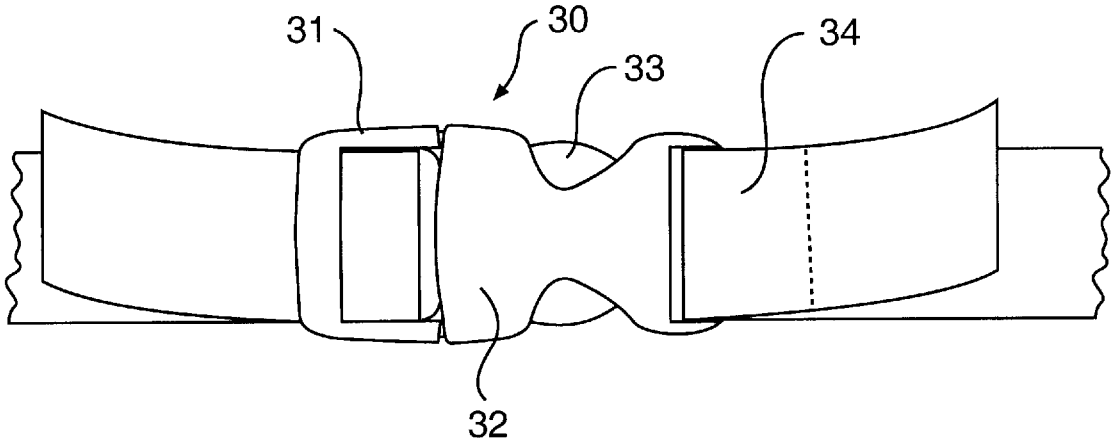
FIG. 5 is a top or plan view, illustrating a portion of the rifle sling, as shown in FIGS. 1–3, and which illustrates a side-release buckle, as incorporated in a preferred embodiment of the invention.

A side-release buckle 30, shown in FIGS. 1, 2 and 5, is of a conventional design. The buckle 30, in a preferred embodiment of the invention, is an ITW NEXUS model TSR 100, which is available from the ITW Nexus Company, or an equivalent thereof. As shown more clearly in FIG. 5, the side-release buckle 30 includes a first element 31 and a second element 32. The first element 31 includes an adjustable fastening segment, so that an end of portion 12' of strap 12 is passed through a first opening over a cross-member and through a second opening in a conventional manner. The path of the end of portion 12', as it is attached to and for adjustment with respect to buckle 30, is illustrated in FIGS. 1 and 2. The first element 31 also includes a tongue 33 which extends into the second element 32. A second end of the portion 12' of the strap 12 is attached to the second element 32 in a conventional manner, as, for example, by stitching or snap fastening means (not shown).

Figure 4:
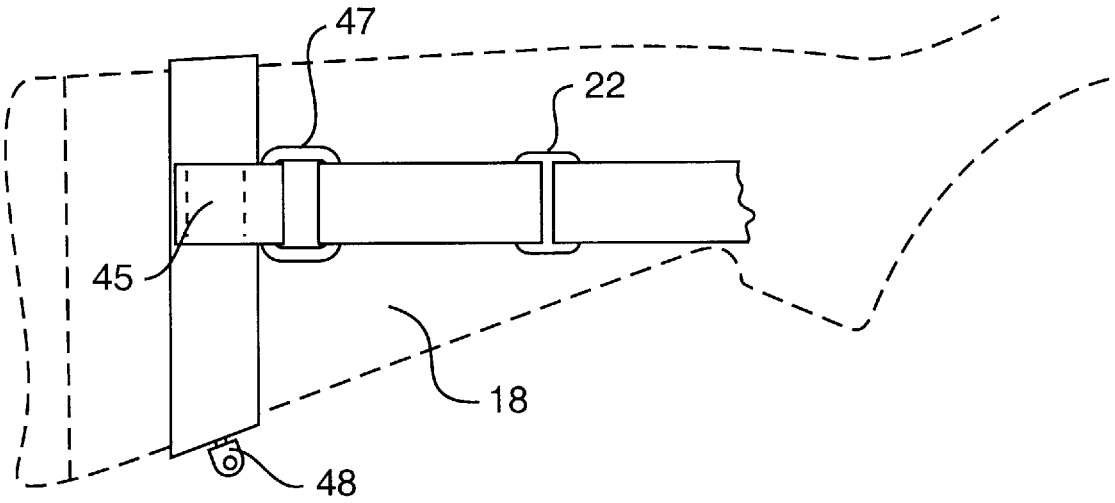
FIG. 4 is a side elevational view showing a portion of a rifle stock, which shows a strap-mount for positioning the rifle sling on a butt portion of the stock.
Figure 8:
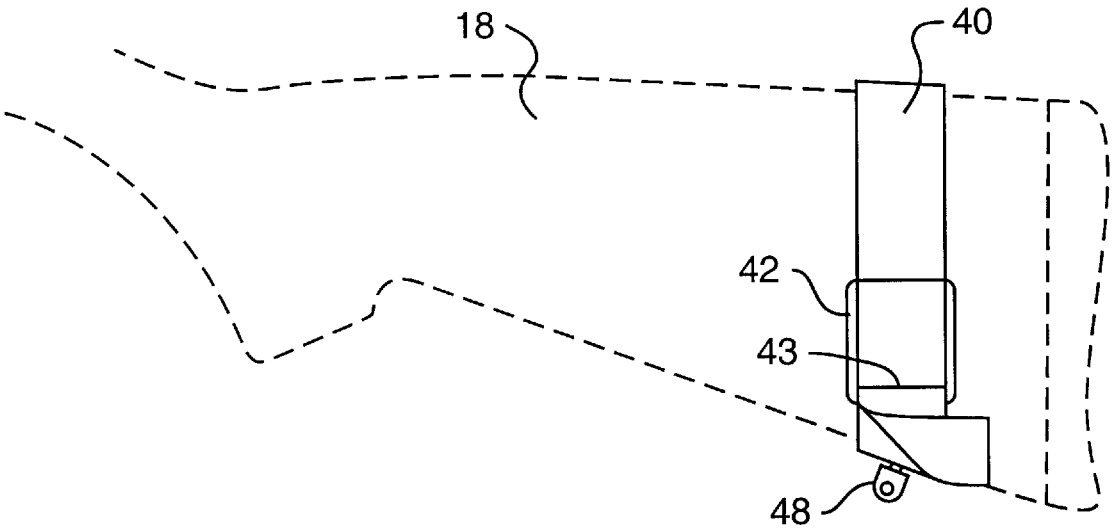
FIG. 8 is a side elevational view of a butt portion of a rifle stock with the strap mount as shown in FIG. 4, but with a top or plan view of a release buckle.
Figure 9:
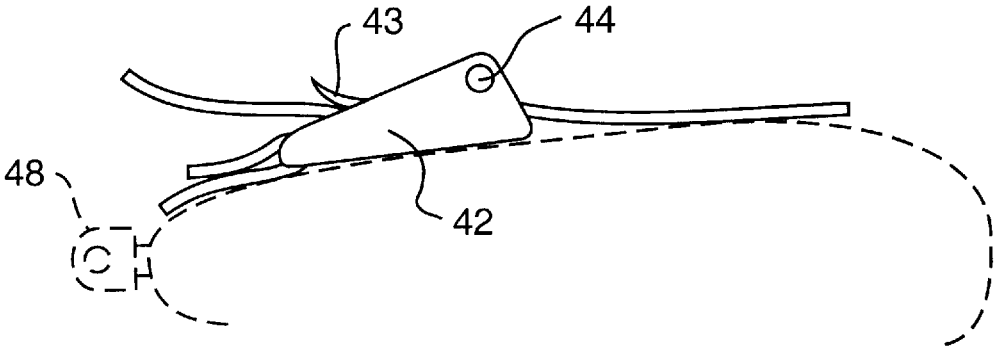
FIG. 9 is a side elevational view of the release buckle shown in FIG. 8, and with the butt portion of the rifle stock shown by dotted lines.

A further embodiment of the invention resides in a rear strap mount for attaching a sling 10 to the butt portion of a rifle stock 18. As shown more clearly in FIGS. 4, 8 and 9, the rear strap member 40 passes around a rear or butt portion of the rifle stock 18, and is held tightly thereto by a friction clamp 42, or Velcro (hook and loop) fastening means. The friction clamp 42 is of conventional design and includes a lever 43 which rotates about a pivot 44. One end of the strap mount 40 passes through the friction clamp 42 and under the lever 43. The lever 43 grips the strap member 40 to hold it securely in place against the butt portion of the stock 18. A positioning pin 48, or screw, passes through the rear strap member 40 (through a small hole or slit) and into a lower portion of the rear part of the stock 18. This pin 48 prevents the rear strap member 40 from moving forwardly along the stock 18. As shown in FIGS. 1, 2 and 4, the sling 10 is attached to the rear strap member 40 through a second strap 45 and O- or D-shaped ring 47.

Figure 6:
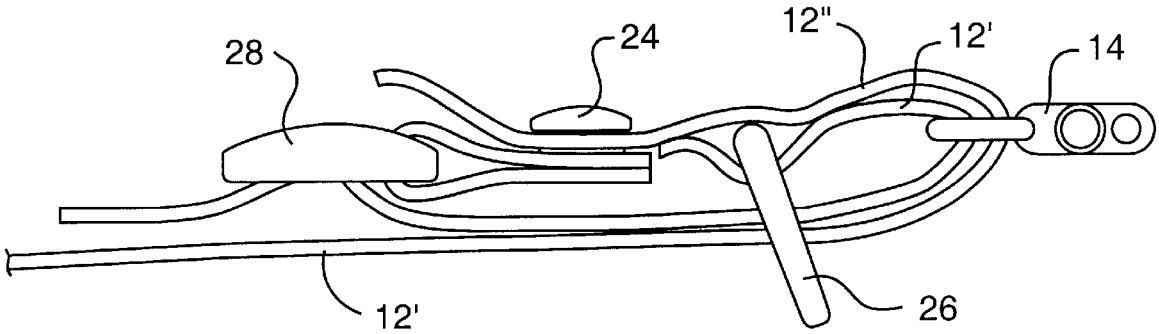
FIG. 6 is a side elevational view of a forward portion of the rifle sling, in accordance with a preferred embodiment of the invention, which illustrates that portion of the sling as it would appear when in a firing position.

FIG. 6 illustrates the front sling swivel 14 and the strap 12 folded over upon itself through the swivel 14. Also shown is an adjustment clip 28, which is used to adjust the length of the sling 10 in its firing position. For example, moving the adjustment clip 28 to the left or toward the rear of the rifle shortens the length of the sling 10. In other words, the sling 10 will be shortened in its firing position. When the clip 28 is positioned for an individual, the snap fastener 24 can be unsnapped, which allows the sling 10 to be fully extended into its backpack position, as shown in FIG. 3. Then, when it is desired to convert the sling to its firing position, the end can be quickly and easily pulled rearwardly and fastened in its preselected position with a snap fastener 24.

The front swivel 14 is shown in more detail in FIGS. 7A and 7B. As shown in FIG. 7A, the strap 12 passes through a ring 50 which is fixed to a first portion 51 of the sling swivel 14. The sling swivel 14 is then swivably fixed to a forward mounting element 52. The sling swivel 14 is also swivable about a pivot 53 and is held in place by a threaded element 54, or equivalent structure.

While the invention has been described in connection with its preferred embodiment, it should be recognized that changes and modification may be made therein without departing from the scope of the appended claims.

What is claimed is:

1. A gun sling for a long gun having a forward portion and a butt portion, said sling comprising:

a longitudinally extending strap having two opposite end regions joined together to form a first overall loop;

first and second attaching means for attaching said overall loop to a long gun at two longitudinally spaced-apart points on the long gun;

means for dividing said overall loop into two generally-equal portions each of which extend between the forward and butt portions of the long gun and which are constructed and arranged for passing over the shoulders of an individual for carrying said long gun on the back of the individual in a backpack position with one of said portions over one of the individual's shoulders and the other of said portions over the other of the individual's shoulders when said portions are in a first position with respect to one another;

means for preventing one end of each of said portions from movement with respect to each other;

means for simultaneously shortening said generally-equal portions and for bringing said sling into a firing position including releasable-fastening means disposed on one of said portions for maintaining said sling in a firing position when fastened;

separate means selectively moveable upon said one of said portions for positioning said releasable-fastening means at a preselected position along said one of said portions, said releasable fastening means being unfastened when in said backpack position;

rapidly-releasable means disposed in connection with one of said portions for opening said one of said portions to allow the long gun to be readily removed from the backpack position for rapid deployment of the long gun; and, means for maintaining said portions of said sling in a generally parallel and superimposed position when said sling is in a second or said firing position and for allowing said portions to be separated when in said first or backpack position.

2. A gun sling for a long gun in accordance with claim 1 in which one of said attaching means includes a forward swivel-mount adapted to be connected to a forward portion of the long gun and in which said sling is folded over upon itself in a superimposed relationship by passing through said forward mount.

3. A gun sling for a long gun in accordance with claim 2 in which said rapid-releasable means is a side-release buckle.

4. A gun sling for a long gun according to claim 3 in which said means for simultaneously shortening said generally equal portions and for bringing said sling into a firing position includes snap-fastening means disposed on one of said portions for maintaining said sling in the firing position.

5. A gun sling for a rifle long gun according to claim 1 in which one of said attaching means includes a strap for passing around the rear portion of a gun stock of the rifle, means for fastening said strap securely to said rear portion of said gun stock and swivel means fixed to said strap and connecting said sling to said strap for permitting movement of said sling with respect to said rifle.

6. A gun sling for a long gun according to claim 1 which includes a rear strap mount for securing one end of said gun sling to a butt portion of a long gun stock, said rear strap mount comprising a first strap member for passing around a butt portion of the gun stock and means for securing said first strap member tightly around said butt portion of the stock, and one of said first and second attaching means attaching the one end of the gun sling to said strap member of said rear strap mount and means for fixing said first strap member with respect to the butt portion of the stock.

7. A gun sling for a long gun according to claim 6, in which said means for attaching the one end of the gun sling to the first strap member comprises a second strap member which is secured to said first strap member.

8. A gun sling for a long gun according to claim 7, in which said means for attaching the one end of the gun sling to the first strap member also includes an O- or D-shaped ring.

9. A gun sling for a rifle having a forward portion and a butt portion, said sling comprising:

a longitudinally extending strap having two opposite end-regions joined together to form a first overall loop; first and second attaching means for attaching said overall loop to a rifle at two longitudinally spaced-apart points on the rifle;

means for dividing said overall loop into two generally-equal portions, each of which extends between the forward and butt portion of the rifle and which are constructed and arranged for passing over the shoulders of an individual for carrying the rifle on the back of the individual in a backpack position with one of said portions over one of the individual's shoulder and the other of said portions over the other of the individual's shoulders when said portions are in a first position with respect to one another;

means for preventing one end of each of said portions from movement with respect to one another; means for simultaneously shortening said generally-equal portions by folding said portions at one end thereof over upon themselves and for bringing said sling into a firing position; and means for accurately and rapidly converting the sling to a support having a preselected length for positioning and maintaining said sling in a preselected firing position; snap-fastening means disposed on one of said portions for maintaining said sling in a firing position and separate means selectively moveable upon said one of said portions for positioning and maintaining said snap-fastening means at a preselected position along said one of said portions with said first and second portions folded over upon themselves in a superimposed relationship wherein said fastening means being fastened when said sling is in said firing position and said fastening means not being fastened when said sling is in said backpack position.

10. A gun sling for a rifle having a forward portion and a butt portion, said sling comprising:

a longitudinally extending strap having two opposite end-regions joined together to form a first overall loop; first and second attaching means for attaching said overall loop to a rifle at two longitudinally spaced-apart points on the rifle;

means for dividing said overall loop into two generally-equal portions each of which extend between the forward and butt portions of the rifle and which are constructed and arranged for passing over the shoulders of an individual for carrying the rifle on the back of the individual in a backpack position with one of said portions over one of the individual's shoulders and the other of said portions over the other of said individual's shoulders when said portions are in a first position with respect to one another;

rapidly-releasable buckle means disposed in one of said portions for separating said one of said portions to allow the rifle to be readily removed from the backpack position for rapid deployment of the rifle;

means for simultaneously shortening said generally-equal portions by folding said portions over upon themselves in a superimposed relationship and for bringing said sling into a firing position;

means for maintaining said sling in said firing position, said means comprising a releasable fastening means disposed on one of said portions for maintaining said sling in the firing position and separate means selectively moveable upon said one of said portions for positioning said releasable fastening means at a preselected position along said one of said portions; and, a sliding clamp positioned close to one of said attaching means for adjusting the length of said portions wherein said fastening means being fastened when said sling is in said firing position and said fastening means not being fastened when said sling is in said backpack position.

11. A gun sling for a rifle according to claim 10 which includes means for maintaining said portions of said strap in a generally parallel and superimposed position when said strap is in a second or said firing position and for allowing said portions to be separated when in said first or backpack position.

* * * * *